US009233535B2

(12) United States Patent
Ito

(10) Patent No.: US 9,233,535 B2
(45) Date of Patent: Jan. 12, 2016

(54) LIQUID DROPLET JETTING APPARATUS

(71) Applicant: Brother Kogyo Kabushiki Kaisha, Aichi-Ken (JP)

(72) Inventor: Atsushi Ito, Aichi-Ken (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 506 days.

(21) Appl. No.: 13/626,026

(22) Filed: Sep. 25, 2012

(65) Prior Publication Data

US 2013/0082117 A1 Apr. 4, 2013

(30) Foreign Application Priority Data

Sep. 30, 2011 (JP) ..... 2011-216079

(51) Int. Cl.

*B41J 2/045* (2006.01)
*B41J 2/14* (2006.01)
*B41J 2/155* (2006.01)

(52) U.S. Cl.

CPC ..... *B41J 2/14032* (2013.01); *B41J 2/14201* (2013.01); *B41J 2/155* (2013.01); *B41J 2002/14266* (2013.01); *B41J 2002/14306* (2013.01); *B41J 2002/14459* (2013.01); *B41J 2202/11* (2013.01)

(58) Field of Classification Search

CPC ..... B41J 2/04581; B41J 2/14201; B41J 2/14233; B41J 2002/1425; B41J 2002/14266; B41J 2002/14274; B41J 2002/14306; B41J 2/14145; B41J 2002/14419

See application file for complete search history.

(56) References Cited

U.S. PATENT DOCUMENTS

| | | | | |
|---|---|---|---|---|
| 8,038,264 | B2 * | 10/2011 | Sugahara | 347/68 |
| 2003/0098901 | A1 | 5/2003 | Okuda | |
| 2007/0091145 | A1 | 4/2007 | Takahashi et al. | |
| 2008/0018703 | A1 * | 1/2008 | Nakano et al. | 347/43 |
| 2009/0167821 | A1 | 7/2009 | Sugahara | |

FOREIGN PATENT DOCUMENTS

| | | |
|---|---|---|
| JP | 4235057 | 8/1992 |
| JP | 2003-127363 | 5/2003 |
| JP | 2007-118311 | 5/2007 |
| JP | 2009-160798 | 7/2009 |
| JP | 2010-082902 | 4/2010 |

* cited by examiner

*Primary Examiner* — Geoffrey Mruk

(74) *Attorney, Agent, or Firm* — Frommer Lawrence & Haug LLP

(57) ABSTRACT

A liquid droplet jetting apparatus is provided with a channel unit including: a liquid supply port which is communicated with a liquid supply section and from which a liquid is supplied; a plurality of nozzle arrays from which liquid droplets of the liquid are jetted; and a plurality of common liquid chambers which are communicated with the liquid supply port and through which the liquid supplied to the liquid supply port is supplied to the plurality of nozzle arrays, and an actuator which applies a jetting energy to the liquid supplied to the plurality of nozzle arrays. The same number of nozzle arrays is communicated with each of the common liquid chambers, and each of the common liquid chambers is communicated with at least one of the plurality of the common liquid chambers at a portion different from a portion communicating with the liquid supply port.

8 Claims, 10 Drawing Sheets

LIQUID DROPLET JETTING APPARATUS

CROSS REFERENCE TO RELATED APPLICATION

The present application claims priority from Japanese Patent Application No. 2011-216079, filed on Sep. 30, 2011, the disclosure of which is incorporated herein by reference in its entirety.

BACKGROUND OF THE INVENTION

1. Field of the Invention

The present invention relates to a liquid droplet jetting apparatus which jets liquid droplets.

2. Description of the Related Art

As a liquid droplet jetting apparatus, an ink-jet head from which liquid droplets of ink are jetted through nozzles is known. The ink-jet head is provided with, for example, a plurality of nozzles which are aligned in two arrays, a plurality of pressure chambers which are aligned in two arrays in a similar manner as the plurality of nozzles and are communicated with the plurality of nozzles respectively, two common liquid chambers (manifold channels) through which the ink is supplied to two arrays of the pressure chambers, and a piezoelectric actuator which applies pressure to the ink in each of the pressure chambers. Respective one end portions of the two common liquid chambers are communicated with ink inflow ports through which the ink is supplied from the outside; and the two common liquid chambers are communicated with each other at respective other end portions thereof on a side opposite to the side on which the ink inflow ports are provided. In this ink-jet head, the liquid droplets of the ink are jetted as follows. That is, the ink is supplied to the pressure chambers belonging to each of the pressure chamber arrays from the common liquid chamber corresponding to each of the pressure chamber arrays, and the pressure is applied to each of the pressure chambers by the piezoelectric actuator. Then, the liquid droplets of the ink are jetted from the nozzle communicating with each of the pressure chambers.

SUMMARY OF THE INVENTION

In a case that the liquid droplets are jetted from many nozzles forming one nozzle array at the same time, liquid (ink) consumption in this nozzle array is increased. Thus, liquid is not supplied to the common liquid chamber corresponding to this nozzle array sufficiently. As a result, a supply shortage of liquid may possibly arise in a part of the nozzles (in particular, nozzles disposed on a terminal side far from the ink flow port). However, like the ink-jet head described above, in a case that the ink-jet head is configured so that the two common liquid chambers are communicated with each other on the terminal side thereof, even if the supply shortage of liquid occurs in one of the common liquid chambers, the liquid can be replenished from the other of common liquid chambers. Thus, the supply shortage of liquid is more likely to be overcome.

However, in the construction in which the plurality of common liquid chambers are communicated with each other, for example, in a case that the liquid droplets are jetted at different jetting timings from the plurality of nozzle arrays corresponding to the plurality of common liquid chambers respectively, the following problem arises. That is, in a case that the supply shortage of liquid is caused in the common liquid chamber corresponding to the nozzle array from which the liquid droplets are jetted at an earlier timing and that the pressure in said common liquid chamber is temporarily reduced, the liquid is supplied from the other common liquid chamber communicating with said common liquid chamber. In this situation, however, the pressure in the other common liquid chamber from which the liquid is replenished is reduced as well. In a case that the liquid droplets are jetted from the nozzle array communicating with the other common liquid chamber in a state that the pressure in the other common liquid chamber is reduced, the jetting of liquid droplets is started in a state that a meniscus of each of the nozzles is pulled inside due to the decreased pressure in the other common liquid chamber. Accordingly, as compared with the nozzle array from which the liquid droplets are jetted at the earlier timing, in the nozzle array from which the liquid droplets are jetted at a later timing, jetting characteristics (liquid droplet speed and liquid droplet amount) may be decreased; and there is fear that the liquid droplets can not be jetted in some cases.

An object of the present teaching is to suppress decrease of jetting characteristics of a nozzle array from which liquid droplets are jetted at a later timing, in a case that jetting timings vary among a plurality of nozzle arrays, each of which corresponds to one of a plurality of common liquid chambers communicated with each other.

According to an aspect of the present teaching, there is provided a liquid droplet jetting apparatus which is controlled by a controller to jet liquid droplets of a liquid supplied from a liquid supply section, the apparatus including: a channel unit which includes; a liquid supply port which is communicated with the liquid supply section and from which the liquid is supplied; a plurality of nozzle arrays each of which is formed of a plurality of nozzles aligned in a first direction and from which the liquid droplets of the liquid are jetted, the nozzle arrays being arranged in a second direction intersecting with the first direction, and the nozzle arrays including a first nozzle array and a second nozzle array from which the liquid droplets are jetted at a later timing than the first nozzle array in accordance with a predetermined jetting order; and a plurality of common liquid chambers which are communicated with the liquid supply port and through which the liquid supplied to the liquid supply port is supplied to the plurality of nozzle arrays, the same number of nozzle arrays, of the plurality of nozzle arrays, being communicated with each of the common liquid chambers, each of the common liquid chambers being communicated with at least one of the plurality of the common liquid chambers at a portion different from a portion communicating with the liquid supply port, and the common liquid chambers including a first common liquid chamber which is communicated with the first nozzle array and a second common liquid chamber which is communicated with the second nozzle array, and an actuator which is controlled by the controller to apply a jetting energy to the liquid supplied to the plurality of nozzle arrays so that the liquid droplets are jetted from each of the nozzle arrays in accordance with the predetermined jetting order, wherein a channel resistance of the second common liquid chamber is smaller than a channel resistance of the first common liquid chamber.

In the liquid droplet jetting apparatus according to the aspect of the present teaching, the same number of nozzle arrays is communicated with each of the common liquid chambers. That is, with respect to a liquid amount supplied to each of the nozzle arrays, there is no difference among the plurality of common liquid chambers, and thus it is generally unnecessary that the channel resistance is made to vary among the plurality of common liquid chambers. However, in a case that the jetting is started from a nozzle array from which the liquid droplets are jetted at the earlier timing in accordance with the jetting order, the liquid is supplied to a common liquid chamber communicating with the nozzle array, from which the liquid droplets are jetted at the earlier timing in accordance with the jetting order, from a common liquid chamber communicating with a nozzle array from which the liquid droplets are jetted at a later timing in accordance with the jetting order. Then, pressure in the common liquid chamber communicating with the nozzle array, from which the liquid droplets are jetted at the later timing, is decreased, and thereby jetting characteristics of the nozzle array, from which the liquid droplets are jetted at the later timing, are adversely affected.

However, in the liquid droplet jetting apparatus according to the aspect of the present teaching, the channel resistance in the common liquid chamber communicating with the nozzle array, from which the liquid droplets are jetted at the later timing in accordance with the jetting order, is small, and thus the liquid is quickly supplied to this common liquid chamber from the liquid supply portion. Therefore, as described above, a great decrease of the pressure in the common liquid chamber is prevented, and a decrease of the jetting characteristics of the nozzle array, from which the liquid droplets are jetted at the later timing in accordance with the jetting order, is suppressed. Noted that, in the present teaching, the channel of each of the common liquid chambers means a portion ranging from a portion communicating with the liquid supply port to a terminal portion on a side opposite to the liquid supply port; and the channel of each of the common liquid chambers does not include a portion communicating with at least one of the plurality of the common liquid chambers.

DESCRIPTION OF THE PREFERRED EMBODIMENTS

Figure 1:
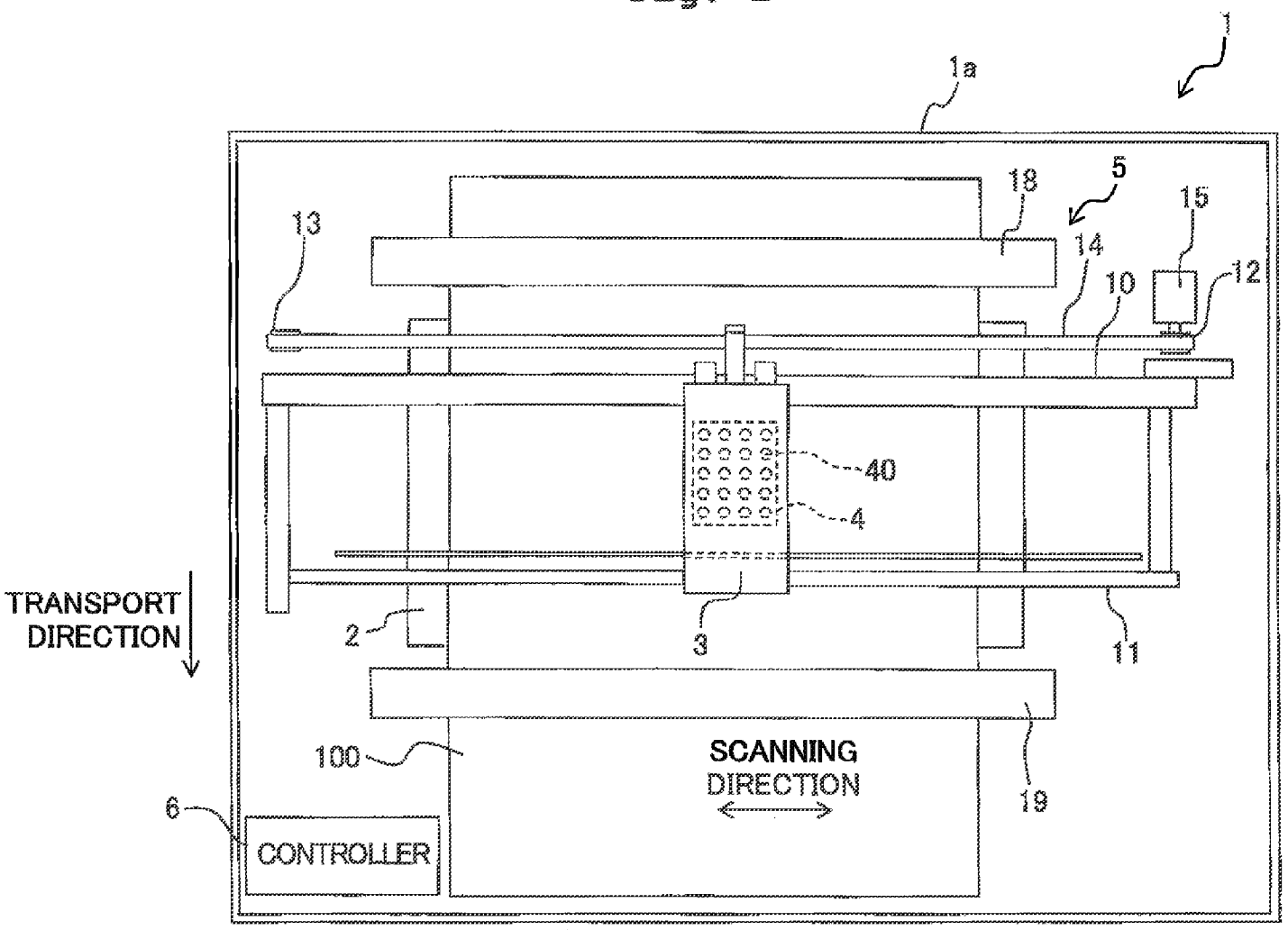
FIG. 1 is a plan view of an ink-jet printer according to this embodiment.

Next, an explanation will be made about an embodiment of the present teaching. At first, a schematic construction of an ink-jet printer 1 will be explained with reference to FIG. 1. As shown in FIG. 1, the ink-jet printer 1 is provided with, for example, a platen 2 on which a recording paper sheet 100 is placed, a carriage 3 which is configured to be reciprocatively movable in a direction parallel to the platen 2 (scanning direction), an ink-jet head 4 (liquid droplet jetting apparatus of the present teaching) which is carried on the carriage 3, a transport mechanism 5 which transports the recording paper sheet 100 in a transport direction perpendicular to the scanning direction, and a controller 6 which is in charge of control of the entire parts or components of the ink-jet printer 1.

The recording paper sheet 100 as a recording medium is placed on a horizontal upper surface of the platen 2. Two guide rails 10, 11 extending parallel in a left-right direction (scanning direction) are provided over or above the platen 2 (a near side (front surface side) of the sheet surface of FIG. 1). The carriage 3 is configured to be reciprocatively movable in the scanning direction along the two guide rails 10, 11 in an area facing the platen 2. Further, an endless belt 14 wound and applied between two pulleys 12, 13 is connected to the carriage 3. When the endless belt 14 is driven to travel by a carriage driving motor 15, the carriage 3 is reciprocatively moved in the scanning direction in accordance with the travel of the endless belt 14.

The ink-jet head 4 is attached to a lower portion of the carriage 3 so that a lower surface of the ink-jet head 4 (the back side of the page of FIG. 1) is parallel to the upper surface of the platen 2. A liquid droplet jetting surface on which a plurality of nozzles 43 are open is formed on the lower surface of the ink-jet head 4. Although illustrations are omitted, the ink-jet head 4 is connected to an ink cartridge in which ink is contained via a tube. Then, the ink-jet head 4 jets the ink supplied from the ink cartridge to the recording paper sheet 100 placed on the platen 2 through the plurality of nozzles 43.

The transport mechanism 5 has two transport rollers 18, 19 which are disposed on opposite sides of the platen 2 to interpose the platen 2 in the transport direction. The two transport rollers 18, 19 are driven by a transport motor 16 (see FIG. 6) to transport the recording paper sheet 100, which is placed on the platen 2, in the transport direction.

The ink-jet printer 1 including the construction described above jets the ink from the ink-jet head 4, which is reciprocatively moved in the scanning direction together with the carriage 3, with respect to the recording paper sheet 100, while transporting the recording paper sheet 100 in the transport direction by the two transport rollers 18, 19. Accordingly, the ink-jet printer 1 records an image and/or letters on the recording paper sheet 100.

Figure 2:
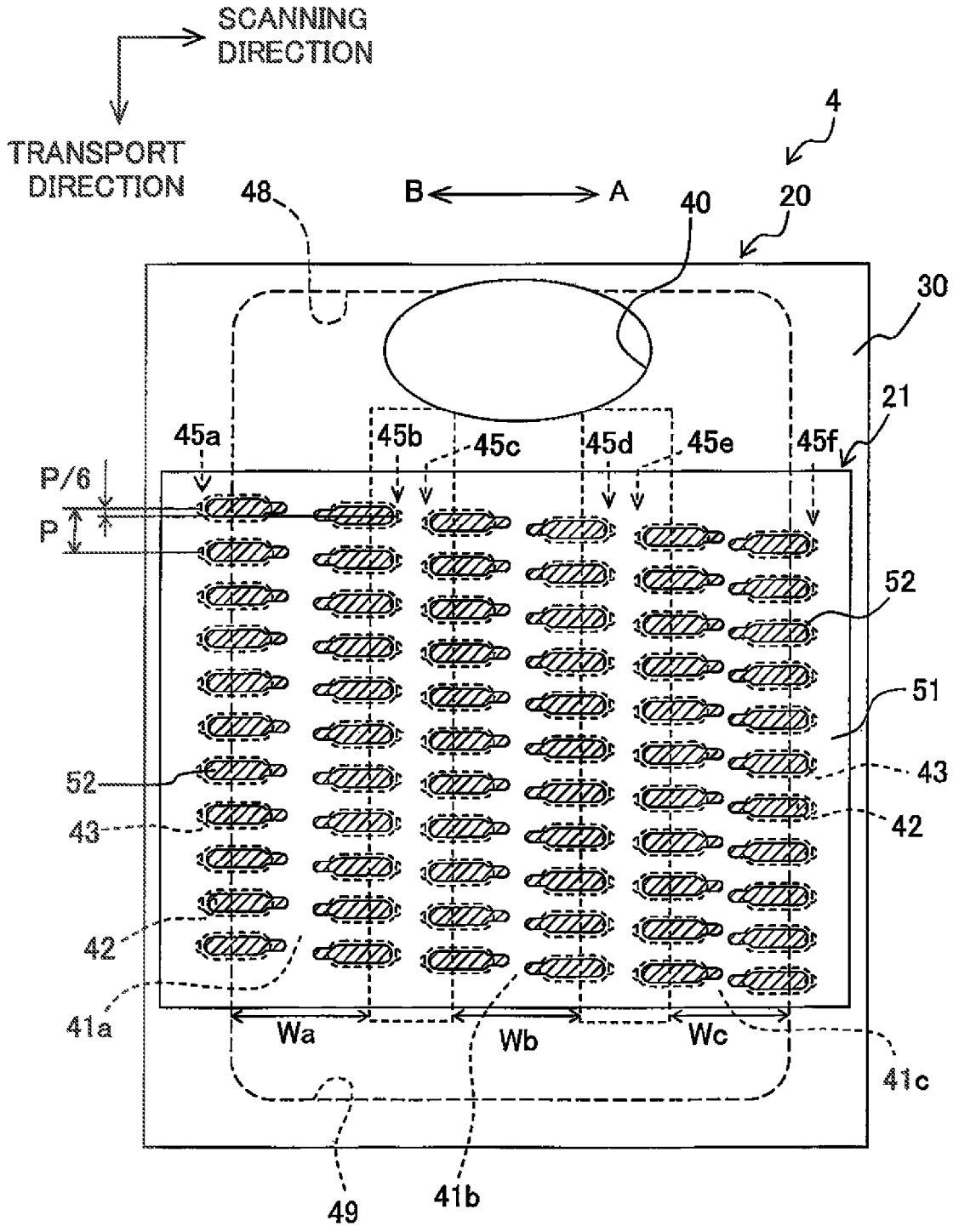
FIG. 2 is a plan view of an ink-jet head.
Figure 3:
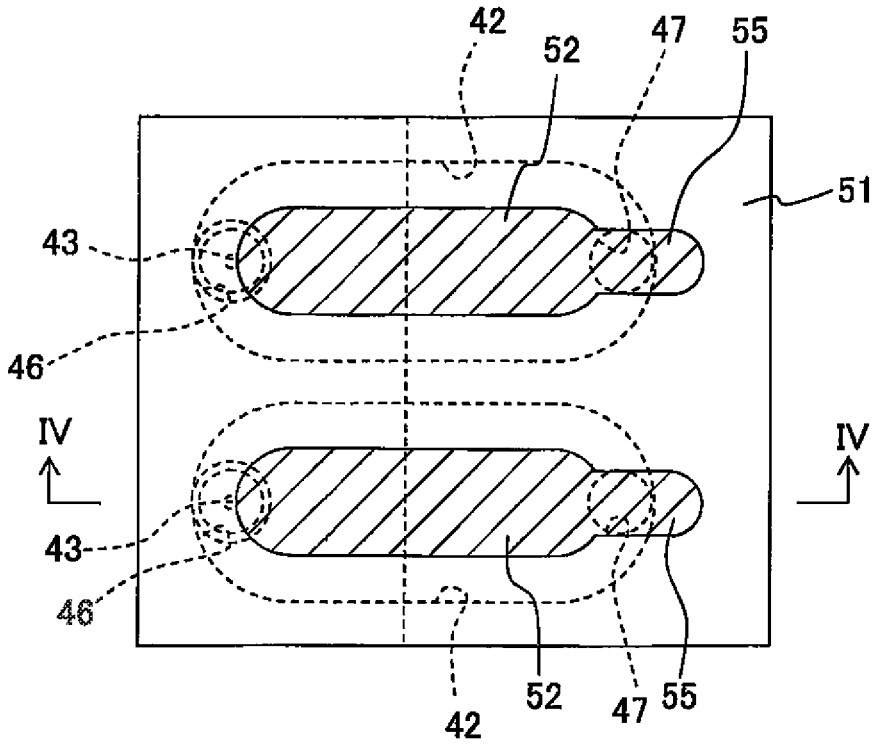
FIG. 3 is a partial enlarged view of FIG. 2.
Figure 4:
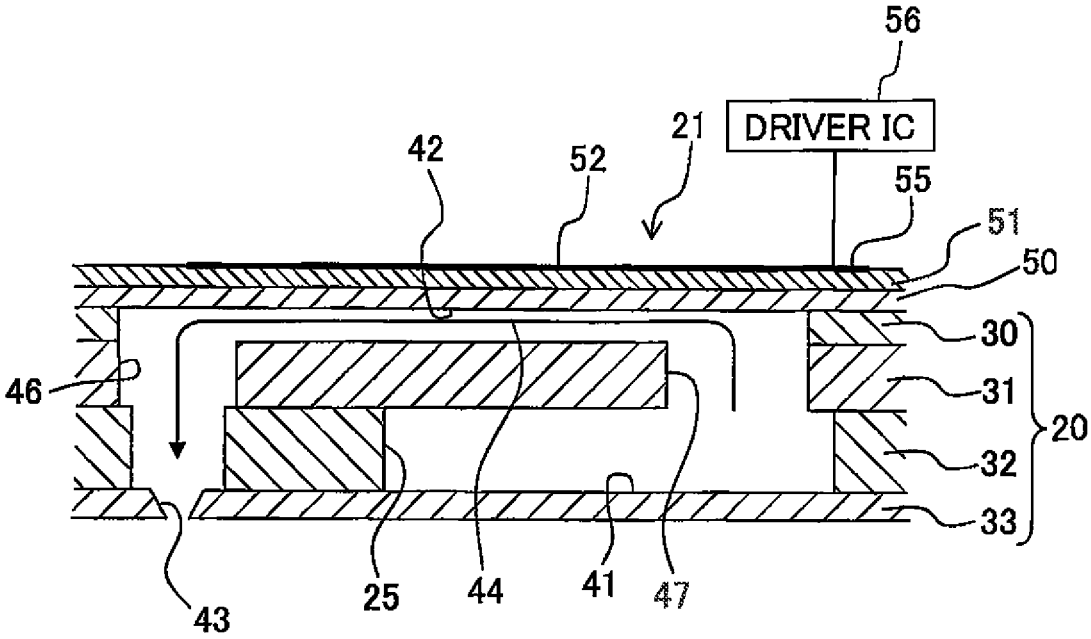
FIG. 4 is a cross-sectional view taken along the line IV-IV of FIG. 3.

Next, an explanation will be made about the ink-jet head 4. As shown in FIGS. 2 to 4, the ink-jet head 4 is provided with a channel unit 20 (channel structure) in which ink channels including the nozzles 43, pressure chambers 42, etc., are formed and a piezoelectric actuator 21 which applies pressure (jetting energy) to the ink in each of the pressure chambers 42.

At first, the channel unit 20 is explained. As shown in FIG. 4, the channel unit 20 has a structure in which four plates of a cavity plate 30, a base plate 31, a manifold plate 32, and a nozzle plate 33 are disposed so as to be stacked in the up-down direction. In each of the plates, a channel hole forming a part of the ink channel is formed. The four plates 30 to 33 are joined to one another by an adhesive. Further, each of the three plates 30 to 32, except for the nozzle plate 33 as the lowermost layer, is a metal plate such as a stainless steel plate and a nickel alloy steel plate. On the other hand, the nozzle plate 33 as the lowermost layer is formed of a synthetic resin material such as polyimide.

As shown in FIGS. 2 to 4, the channel unit 20 which is a stack of the four plates 30 to 33 includes an ink supply port 40 which is connected to the ink cartridge (not shown) via the tube, three manifolds 41 (common liquid chambers) which are communicated with the ink supply port 40 and extend parallel to one another, and a plurality of individual ink channels 44 extending from the respective manifolds 41 via the plurality of pressure chambers 42 to arrive at the plurality of nozzles 43.

An ink channel structure of the channel unit 20 is described in detail. At first, six arrays of nozzle arrays 45 (45*a* to 45*f* aligned in the scanning direction are formed in the nozzle plate 33 as the lowermost layer in the channel unit 20. Each of the nozzle arrays 45 has the plurality of nozzles 43, each of which is aligned at a predetermined pitch P in the transport direction. That is, in this embodiment, the transport direction and a direction in which the nozzles 43 are aligned correspond to the first direction of the present teaching. Further, the scanning direction and a direction in which the nozzle arrays 45*a* to 45*f* are arranged correspond to the second direction of the present teaching. All of six arrays of the nozzle arrays 45*a* to 45*f* have the same number of nozzles 43. Further, six arrays of the nozzle arrays 45*a* to 45*f* are arranged so that the arrangement position of each of the nozzle arrays 45*a* to 45*f* is deviated, in the transport direction, by a distance corresponding to one-sixth of the predetermined pitch P (P/6) in the order of the nozzle arrays 45 from the left side of FIG. 2.

On the other hand, in the cavity plate 30 arranged as the uppermost layer, as shown in FIG. 2, six arrays of pressure chamber arrays aligned in the scanning direction are formed corresponding to six arrays of the nozzle arrays 45 respectively. Each of the pressure chamber arrays has the plurality of pressure chambers 42, each of which is aligned at a predetermined pitch P in the transport direction, in the same manner as the nozzles 43. Further, as shown in FIG. 4, a communication channel 46 which communicates the pressure chamber 42 with the nozzle 43 is formed in a base plate 31 and a manifold plate 32 provided between the cavity plate 30 and the nozzle plate 33. Furthermore, as shown in FIG. 2, one ink supply port 40 (liquid supply port), which is connected to the unillustrated ink cartridge via the tube, is formed in the cavity plate 30 at one end portion (end portion on the upper side in FIG. 2) in the transport direction.

In the manifold plate 32, three elongated holes 25 extending in the transport direction are formed. As shown in FIG. 4, each of the elongated holes 25 penetrates through the manifold plate 32 in a thickness direction. Then, each of the three elongated holes 25 is blocked, from an upward-downward direction (a direction of stacking of the plates) with the base plate 31 disposed on the upper side and the nozzle plate 33 disposed on the lower side. Accordingly, three manifolds 41 (41*a* to 41*c*) as shown in FIG. 2 are formed.

As shown in FIG. 2, one manifold 41 is arranged between two arrays of nozzle arrays 45 (pressure chamber arrays) as viewed in a plan view to extend in the transport direction. This manifold 41 is communicated with the pressure chambers 42 forming two arrays of the pressure chamber arrays arranged on opposite sides of the manifold 41. That is, it is configured that the ink is supplied from one manifold 41 to two arrays of the pressure chamber arrays (two arrays of the nozzle arrays 45). Noted that, as shown in FIG. 2, one end portion of each of the three manifolds 41*a* to 41*c* in a longitudinal direction (end portion on the upper side in FIG. 2) is communicated in common, via a connecting channel 48, with one ink supply port 40 formed in the cavity plate 30 as the upper most layer. Further, the three manifolds 41*a* to 41*c* are configured to communicate with one another by a connecting channel 49 at terminal portions (end portions on the lower side in FIG. 2) on a side opposite to the portions (communicating portions) communicating with the ink supply port 40. Noted that, in this embodiment, the channel of each of the manifolds 41 means a portion ranging from the portion communicating with the ink supply port 40 to the terminal portion, on the side opposite to the ink supply port 40, which does not include the connecting channel 49. Further, the ink flows in each of the manifolds 41 from the portion communicating with the ink supply port 40 toward the terminal portion separated from the ink supply port 40. A direction, in which the ink in each of the manifolds 41 flows, corresponds to "liquid flow direction" of the present teaching.

Further, a width W (length along a surface direction of the manifold plate 32 in a cross section perpendicular to the longitudinal direction of the manifold 41, which is a direction in which the ink flows) varies among the three manifolds 41*a* to 41*e* (elongated holes 25). In particular, as shown in FIG. 2, the manifold 41*c* positioned on the right side in FIG. 2 has the smallest width Wc, the manifold 41*b* positioned between the manifolds 41*a* and 41*c* has the second smallest width Wb, and the manifold 41*a* positioned on the left side in FIG. 2 has the largest width Wa. As described above, the three elongated holes 25, which form the three manifolds 41*a* to 41*c* respectively, are holes penetrating through the manifold plate 32. Thus, each of the three manifold 41*a* to 41*e* has a depth which is the same as a thickness of the manifold plate 32. Therefore, a channel sectional area of each of the three manifolds 41*a* to 41*c* is proportional to one of the widths W. Further, channel resistance is generally inversely proportional to the channel sectional area. Thus, in this embodiment, the channel resistance of the manifold 41 is inversely proportional to the width W. That is, the channel resistance becomes smaller in the order of the manifold 41*c*, the manifold 41*b*, and the manifold 41*a*. Noted that, since the ink flows along the surface direction of the manifold plate 32 in each of the manifolds 41*a* to 41*c*, the channel sectional area of each of the manifolds 41*a* to 41*c* is an area of a cross section perpendicular to the surface direction of the manifold plate 32. The reason why each of the manifolds 41 has the construction described above will be described in detail later on.

As shown in FIG. 4, there are formed, in the base plate 31 positioned between the cavity plate 30 and the manifold plate 32, a plurality of communication channels 47, each of which communicates one of the manifolds 41 with the pressure chambers 42 forming two arrays of the pressure chamber arrays corresponding to one of the manifolds 41.

By joining the four plates 30 to 33 described above in a stacked state, there are formed, in the channel unit 20, many individual ink channels 44, each of which extends from the manifold 41 via the communication channel 47, the pressure chamber 42, and the communication channel 46 to arrive at the nozzle 43, as shown in FIG. 4.

Next, an explanation will be made about the piezoelectric actuator 21. As shown in FIGS. 2 to 4, the piezoelectric actuator 21 is provided with a vibration plate 50 which is joined onto the upper surface of the channel unit 20 (cavity plate 30), a piezoelectric layer 51 which is formed on the upper surface of the vibration plate 50 to face the plurality of pressure chambers 42, and a plurality of individual electrodes 52 which are arranged on the upper surface of the piezoelectric layer 51.

The vibration plate 50 is, in a plane view, an approximately rectangular metallic plate which is, for example, formed of an iron-base alloy such as stainless steels, a copper-base alloy, a nickel-base alloy, a titanium-base alloy, or the like. This vibration plate 50 is adhered to the upper surface of the channel unit 20 to cover the plurality of pressure chambers 42. Further, the upper surface of the vibration plate 50 having conductivity is opposed to the plurality of individual electrodes 52 with the piezoelectric layer 51 intervening therebetween. The vibration plate 50 plays a role of the common electrode that generates an electric field in a thickness direction in the piezoelectric layer 51. The vibration plate 50 as the above common electrode is constantly kept at ground potential.

The piezoelectric layer 51, which is made of a piezoelectric material of which major component is lead zirconate titanate (PZT) that is a solid solution of lead titanate and lead zirconate and is a ferroelectric, is formed on the upper surface of the vibration plate 50 (the surface not facing the pressure chambers 42). The piezoelectric layer 51 is formed in a flat or planar form while extending over the pressure chambers 42.

Each of the individual electrodes 52 having a substantially elliptical shape slightly smaller than the pressure chamber 42 as viewed in a plan view is formed on the upper surface of the piezoelectric layer 51. Each of the individual electrodes 52 is arranged at the position facing the center portion of one of pressure chambers 42. Each of the individual electrode 52 is formed of a conductive material including, for example, gold, copper, silver, palladium, platinum, and titanium.

There are provided, on the upper surface of the piezoelectric layer 51, a plurality of contact point portions 55 each of which is led out from one end portion of one of the individual electrodes 52 (end portion on a side opposite to the nozzle 43 as viewed in a plan view) to an area which is not facing each of the pressure chambers 42. The contact point portions 55 are connected to a flexible printed circuit (FPC) not shown in the diagram. Then, a driving voltage is applied to the individual electrodes 52 from a driver IC 56 mounted on the FPC via the contact point portions 55.

Next, the operation of the piezoelectric actuator 21 at the time of jetting of the ink from the nozzle 43 is explained. When the driving voltage is applied to one individual electrode 52 from the driver IC 56, a potential difference occurs between said one individual electrode 52 and the vibration plate 50 as the common electrode kept at the ground potential, and thereby the electric field in the thickness direction acts in a portion, of the piezoelectric layer 51, sandwiched between the individual electrode 52 and the vibration plate 50. When the direction of the above electric field is same as a polarization direction of the piezoelectric layer 51, the piezoelectric layer 51 extends (elongates) in the thickness direction which is the polarization direction thereof and contracts in a planar direction. With the contraction deformation (deformation due to contraction) of the piezoelectric layer 51, the portion of the vibration plate 50 facing the pressure chamber 42 is deformed to form a projection toward the pressure chamber 42 (unimorph deformation). At this time, since the volume of the pressure chamber 42 reduces, the pressure (jetting energy) is applied to the ink in the pressure chamber 42, and thereby liquid droplets of the ink are jetted from the nozzle 43 communicating with the pressure chamber 42.

<Detailed Explanation About Manifold 41>

In a case that the recording operation in which duty is high (the total amount of ink jetted from the ink-jet head 4 per unit time is large), such as a so-called solid printing, is performed, the liquid droplets of the ink are jetted from almost all of the nozzles 43 belonging to each of the nozzle arrays 45. In such a case, when the ink is jetted from many nozzles 43 belonging to one of the nozzle arrays 45 at the same time, ink consumption in this nozzle array 45 is large, and the ink is not supplied from the ink supply port 40 to the manifold 41 sufficiently. In particular, a supply shortage of the ink is more likely to occur in the nozzles 43 at a terminal side of the nozzle array 45 (a side separated from the ink supply port 40), and there is fear that the jetting failure occurs in the nozzles 43.

In this embodiment, it is adopted a construction in which the ink is supplied from one manifold 41 to two arrays of the nozzle arrays 45 arranged on opposite sides of the manifold 41. However, in a case that the liquid droplets of the ink are jetted at different jetting timings from two arrays of the nozzle arrays 45, another problem may arise. For example, in a case that one bold (thick) line is formed on the recording paper sheet 100, it is necessary that the plurality of nozzle arrays 45 be made to have different jetting timings to align landing positions (dot formation positions) of the liquid droplets jetted from the nozzle arrays 45 at the same position on the recording paper sheet 100. In order to align the dot formation positions of two arrays of the nozzle arrays 45 disposed to be deviated in the scanning direction, the liquid droplets are required to be jetted as follows. That is, the liquid droplets are jetted from one nozzle array 45 positioned on a downstream side of the moving direction of the carriage 3, and then the liquid droplets are jetted from the other nozzle array 45 when the other nozzle array 45 arrives at a position at which the liquid droplets are jetted from said one nozzle array 45.

In a case that two arrays of the nozzle arrays 45 communicating with one manifold 41 have different jetting timings, immediately after the ink is jetted from one of the nozzle arrays 45, the pressure in the manifold 41 is decreased rapidly by consuming a large amount of ink. Thus, in the other of the nozzle arrays 45, the ink is jetted in a state that a meniscus of the nozzles 43 is pulled inside, and thus jetting characteristics (liquid droplet speed and liquid droplet amount) of the other of the nozzle arrays 45 is decreased.

From the above viewpoint, it is preferable to prevent the pressure in the manifold 41 from decreasing greatly by quickly replenishing the ink to the manifold 41, when the large amount of ink is consumed due to the jetting of each of the nozzle arrays 45. In this regard, in this embodiment, each of the three manifolds 41*a* to 41*e* is communicated with other manifolds 41 at the terminal portion on the side opposite to the portion communicating with the ink supply port 40. Accordingly, when the ink is jetted from the nozzle array 45 communicating with one manifold 41, the ink is supplied also from other manifolds 41 independently of the supply of the ink from the ink supply port 40. Thus, the pressure in said one manifold 41 is prevented from greatly decreasing. Further, in a case that two arrays of the nozzle arrays 45 are communicated with one manifold 41, it is possible to suppress the decrease of pressure in the manifold 41 caused when the ink is jetted from one of the two nozzle arrays 45 at an earlier jetting timing. Thus, an adverse effect on the other of the two nozzle arrays 45 from which the ink is jetted at a later timing is reduced.

Noted that it is not indispensable that the three manifolds 41*a* to 41*c* are communicated with one another at terminal portions thereof. However, in a case that one manifold 41 is tried to be communicated with another manifold 41 at an intermediate portion in the longitudinal direction thereof, it is necessary to provide the ink channel structure so that the communicating portion between the manifolds 41 do not interfere with each of the nozzle arrays 45. Therefore, in respect of a simpler channel structure, the structure in which the manifolds 41 are communicated with one another at terminal portions thereof has an advantage. Further, the supply shortage of the ink is more likely to occur at each of the terminal portions separated from the ink supply port 40. Thus, also from a viewpoint of solving the supply shortage of the ink, the structure in which each of the manifolds 41 is communicated with other manifolds 41 at the terminal portion has the advantage.

By the way, in the case that the three manifolds 41*a* to 41*c* are configured to be communicated with one another and that the nozzle arrays 45 communicating with the respective three manifolds 41*a* to 41*c* have different jetting timings, the decrease of pressure in the manifold 41 communicating with the nozzle array 45 from which the ink is jetted at the earlier jetting timing is transmitted to other manifolds 41, and thereby the jetting of the ink, at the later timing, from the nozzle array(s) 45 communicating with the other manifold(s) 41 may be adversely affected.

The same number of (two arrays of) nozzle arrays 45 is communicated with each of the three manifolds 41*a* to 41*c*, and there is no difference in respective ink amounts supplied from the respective three manifolds 41*a* to 41*c*. Therefore, the channel resistance does not need to vary among the three manifolds 41*a* to 41*c*. However, in order to solve the above problem, the three manifolds 41*a* to 41*c* are configured to have the different widths in this embodiment as shown in FIG. 2. An explanation will be made with reference to FIGS. 5A to 5C about flow of the ink among the manifolds 41 in a case that the nozzle arrays 45 communicating with the respective three manifolds 41*a* to 41*c* have the different jetting timings. Noted that, in order to make the explanation easy to understand, FIGS. 5A to 5C are shown as plan views of the manifold plate 32 by omitting the piezoelectric actuator 21, the cavity plate 30, and the base plate 31, those of which are arranged over or above the manifold plate 32 of the ink-jet head 4.

Figure 5A:
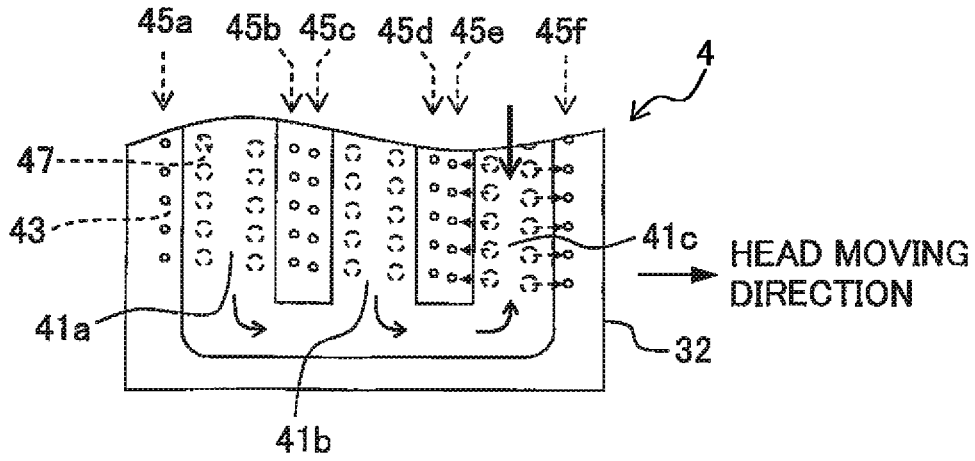
FIGS. 5A, 5B, and 5C are illustrative views each illustrating flow of ink among manifolds at each of the jetting timings of nozzle arrays communicating with three manifolds respectively.
Figure 5B:
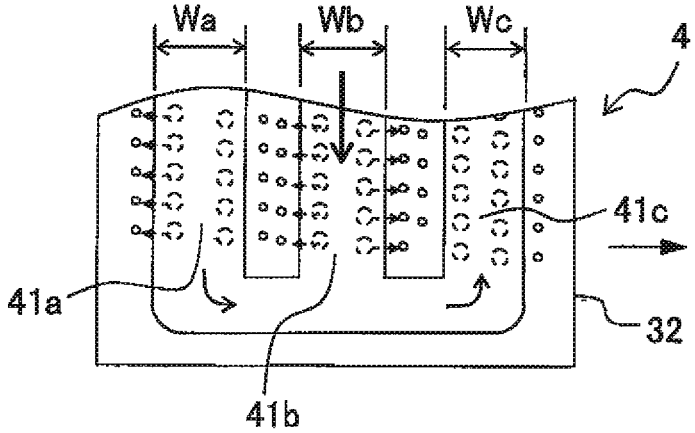
Figure 5C:
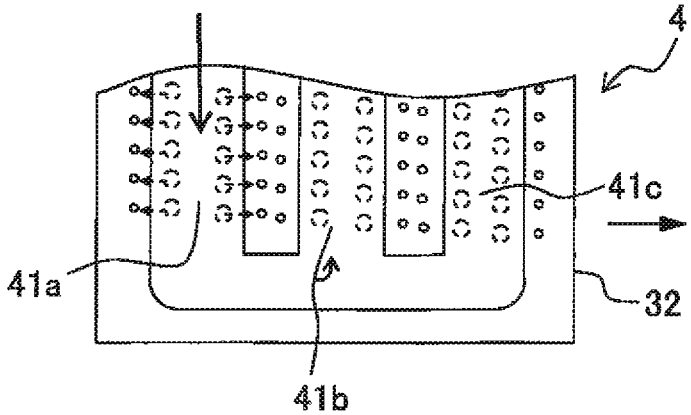

In FIGS. 5A to 5C, it is assumed that the ink-jet head 4 moves rightward (A direction in FIG. 2) together with the carriage 3. The ink is jetted at a timing at which each nozzle array 45 arrives at a predetermined position of the recording paper sheet 100 in the width direction in the order starting from the nozzle array 45*f* disposed on the right side in FIG. 5A (a side of front end in the moving direction). That is, in the order of the manifold 41*c* on the right side, the manifold 41*b* positioned between manifolds 41*a* and 41*c*, and the manifold 41*a* on the left side, the ink is jetted from each of the nozzle arrays 45 corresponding to one of the manifolds 41*a* to 41*c*. Regarding this, the manifold 41*a* positioned on the left side having the nozzle array 45 from which the ink is jetted at the last timing has the largest width Wa, the manifold 41*b* positioned between the manifolds 41*a* and 41*c* has the second largest width Wb, and the manifold 41*c* positioned on the right side has the smallest width Wc.

When the carriage 3 is started to move rightward in FIGS. 5A to 5C in a state that the ink is not jetted from the ink-jet head 4, at first, the ink is jetted from two arrays of nozzle arrays 45*f*, 45*e*, in that order, those of which are communicated with the manifold 41*c* positioned on the right side, as shown in FIG. 5A. Although the pressure in the manifold 41*c* is temporarily decreased by consuming the ink at the time of the jetting of the ink, the ink is supplied to the manifold 41*c* not only from the ink supply port 40 disposed on the upstream side in the transport direction, but also from the other two manifolds 41*a*, 41*b* which are communicated with the manifold 41*c* at the terminal portions on the downstream side in the transport direction.

On the other hand, in each of the manifold 41*a* positioned on the left side and the manifold 41*b* positioned between 41*a* and 41*c*, the pressure is decreased by supplying the ink to the manifold 41*c* positioned on the right side. Next, the ink is jetted from two arrays of the nozzle arrays 45*d*, 45*e*, in that order, those of which are communicated with the manifold 41*b* positioned between 41*a* and 41*c* in the state that the pressure in each of the manifolds 41*a* and 41*b* is decreased. Here, the width Wb of the manifold 41*b* positioned between the manifolds 41*a* and 41*c* is larger than the width Wc of the manifold 41*c* positioned on the right side, and the channel resistance of the manifolds 41*b* is smaller than that of the manifold 41*c*. Therefore, when the pressure in the manifold 41*b* is decreased due to the ink supply to the manifold 41*c* positioned on the right side, the ink is quickly replenished from the ink supply port 40 to the manifold 41*b*. Accordingly, it is possible to prevent the pressure from greatly decreasing before the ink is jetted from the nozzle arrays 45*d*, 45*c*, and thereby making it possible to suppress the decrease of the jetting characteristics of the nozzle arrays 45*d*, 45*c*.

In a case that the ink is jetted from the nozzle arrays 45*d*, 45*e* communicating with the manifold 41*b* positioned between the manifolds 41*a* and 41*c*, the ink is supplied also from the manifold 41*a* positioned on the left side. On the other hand, the flow of the ink generated by the ink supply from the manifold 41*b* to the manifold 41*c* remains between the manifold 41*b* and the manifold 41*c* positioned on the right side. Thus, the ink is hardly supplied from the manifold 41*c* positioned on the right side to the manifold 41*b* positioned between the manifolds 41*a* and 41*c*.

Further, the ink is jetted from two arrays of the nozzle arrays 45*b*, 45*a*, in that order, those of which are communicated with the manifold 41*a* positioned on the left side. The ink is jetted at the last timing from the nozzle arrays 45*b*, 45*a* communicating with the manifold 41*a* disposed on the left side, among the nozzle arrays 45 communicating with the respective three manifolds 41; and the ink flows out from the manifold 41*a* when the ink is jetted from the nozzle arrays 45 communicating with the other two manifolds 41*b*, 41*c*. Thus, the pressure in the manifold 41*a* is more likely to decrease greatly. However, the width Wa of the manifold 41*a* is larger than the widths Wb and Wc of the other two manifolds 41*b* and 41*c*, and the channel resistance of the manifold 41*a* is the smallest among the manifolds 41*a* to 41*c*. Thus, the ink is supplied quickly from the ink supply port 40 to the manifold 41*a* when the pressure is decreased. Therefore, it is prevented that the pressure in the manifold 41*a* is greatly decreased before the ink is jetted from each of the nozzle arrays 45*b*, 45*a*, and thereby making it possible to suppress the decrease of the jetting characteristics of the nozzle arrays 45*b*, 45*a*.

Figure 6:
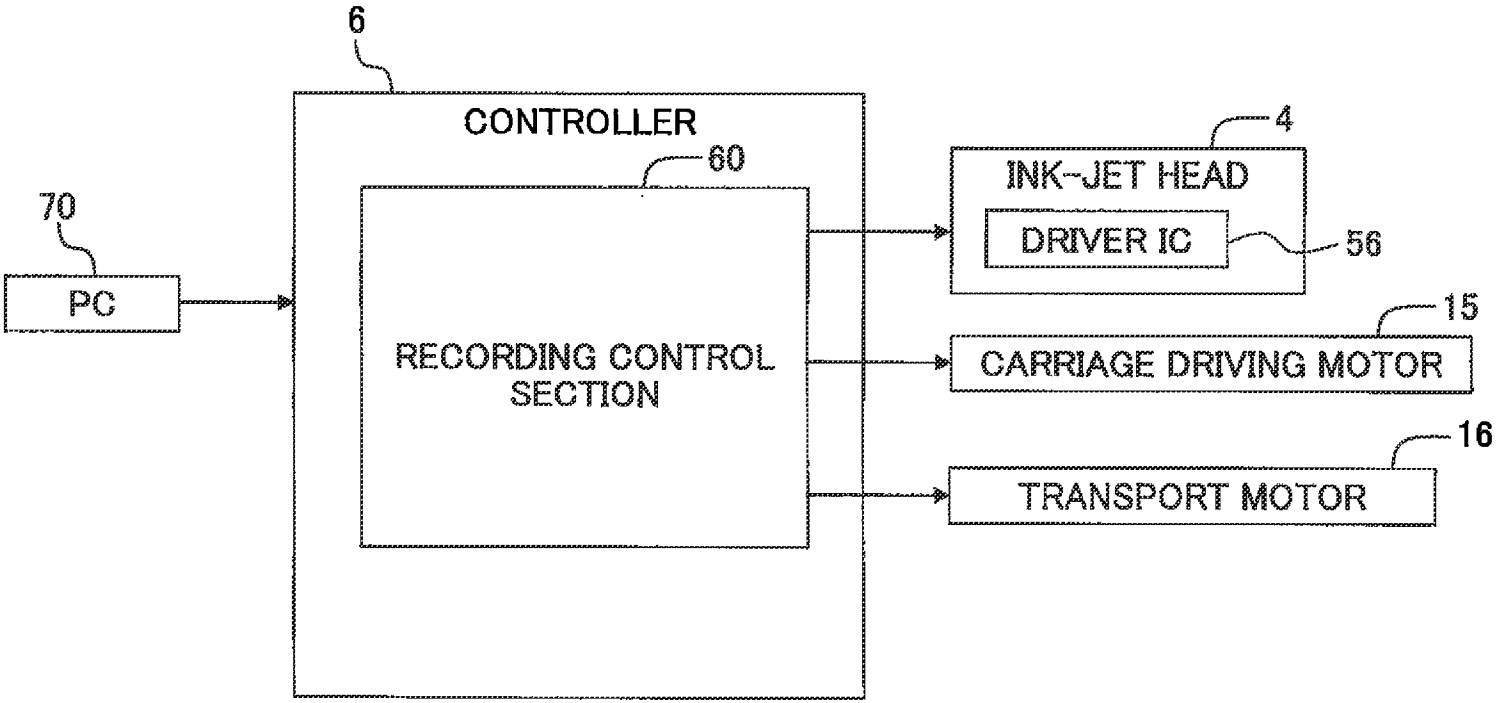
FIG. 6 is a block diagram schematically showing an electrical construction of the ink-jet printer.

Next, an explanation will be made with reference to the block diagram of FIG. 6 about an electrical construction of the ink-jet printer 1. As shown in FIG. 6, the controller 6 is provided with a recording control section 60 which controls the recording operation of the ink-jet printer 1 to the recording paper sheet 100. The recording control section 60 controls the driver IC 56 of the ink-jet head 4, the carriage driving motor 15 which drives the carriage 3, the transport motor 16 which drives the transport rollers 18, 19 of the transport mechanism 5, etc., based on data, inputted from the PC 70, in relation to an image, letters, and the like, to be recorded. Accordingly, the ink-jet printer 1 records a desired image, letters, and the like, on the recording paper sheet P.

By the way, in a case that the recording operation in which the duty is high is performed, such as the solid printing, it is necessary that the ink is jetted at the later timing from each of the nozzle arrays 45*a*, 45*b* communicating with the manifold 41*a* having the large width Wa. In other words, the ink is jetted only when the carriage 3 which carries the ink-jet head 4 moves rightward (A direction in FIG. 2), and the ink is not jetted when the carriage 3 moves leftward (B direction in FIG. 2) (one-way printing to the right direction).

On the other hand, in a case that the recording operation in which the duty is low is performed, such as text printing, the number of nozzles 43, belonging to one of the nozzle arrays 45, from which the ink is jetted at the same time is small. Thus the ink consumption in each of the manifolds 41 is small.

Therefore, even if the pressure in the manifold 41 communicating with the nozzle array 45 from which the ink is jetted at the later timing is decreased, the degree of decrease is small. Thus, the jetting characteristics of the nozzle array 45 from which the ink is jetted at the later timing are hardly affected by the decrease of the pressure. That is, it is no problem even when the ink is jetted at the later timing from the nozzle arrays 45*f*, 45*e* communicating with the manifold 41*c* having the large channel resistance. Accordingly, in the case that the duty is low, the ink can be jetted not only when the carriage 3 moves rightward but also when the carriage 3 moves leftward (two-way printing).

In view of this, in a case that data in relation to the image, letters, etc., to be recorded is inputted from the PC 70, the recording control section 60 finds, based on the inputted data, an entire amount of ink (duty) to be jetted from the ink-jet head 4 per unit time when the recording of the image and the like is performed. In a case that the duty is not less than a predetermined value, the unidirectional printing to the right direction is performed by the ink-jet head 4. On the other hand, in a case that the duty is less than the predetermined value, the bidirectional printing is performed by the ink-jet head 4. By doing so, it is possible to shorten a time required for the recording operation of the low duty in which a high-speed printing is generally required.

Next, modified embodiments in which various modifications are made in the embodiment will be described below. The same reference numerals are assigned to components having the same structure as in the embodiment, and the description of such components is appropriately omitted.

In a case that each of the manifolds 41 has the large width, the ink-jet head 4 becomes larger. Thus, it is preferable that only the manifold 41 which really needs to have the small channel resistance has the large width. From this viewpoint, the following configuration is allowable. That is, it is assumed that the ink is jetted when the carriage 3 moves in the A direction in FIG. 2, the two manifolds 41*b*, 41*c* arranged on the side of the first row in the moving direction have the same width W (channel resistance), and only the manifold 41*a*, arranged on the left side, which has the nozzle array 45 from which the ink is jetted at the last timing has a larger width W than those of the two manifolds 41*b*, 41*c*.

In the embodiment described above, by increasing the width of the manifold 41, the channel section area of the manifold 41 is increased and the channel resistance in the manifold 41 is decreased. However, it is allowable that the channel resistance is decreased by increasing depth of the manifold 41 in the thickness direction of the manifold plate.

Figure 7A:
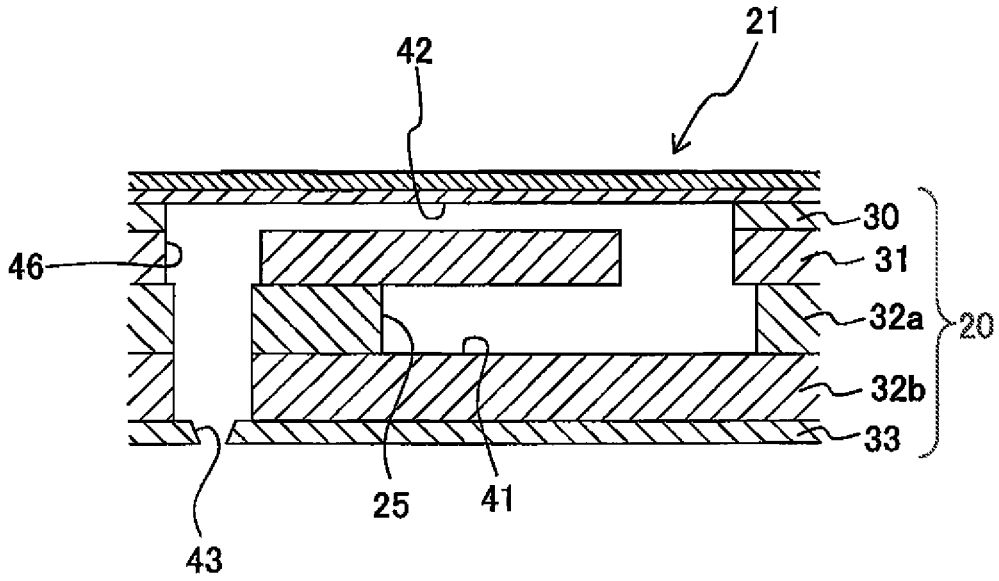
FIGS. 7A and 7B are cross-sectional views corresponding to FIG. 4, each illustrating an ink-jet head of a modified embodiment.
Figure 7B:
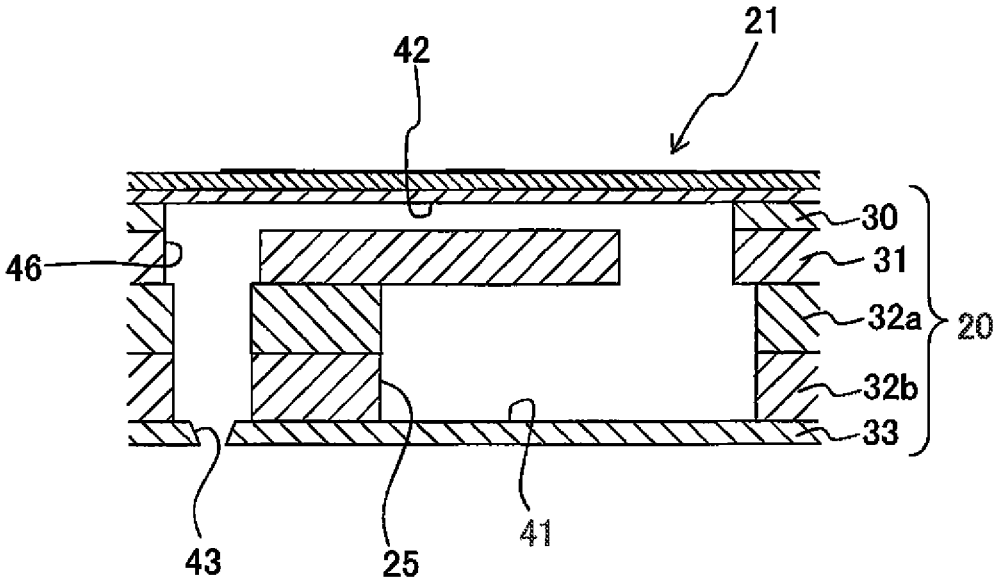
Figure 8A:
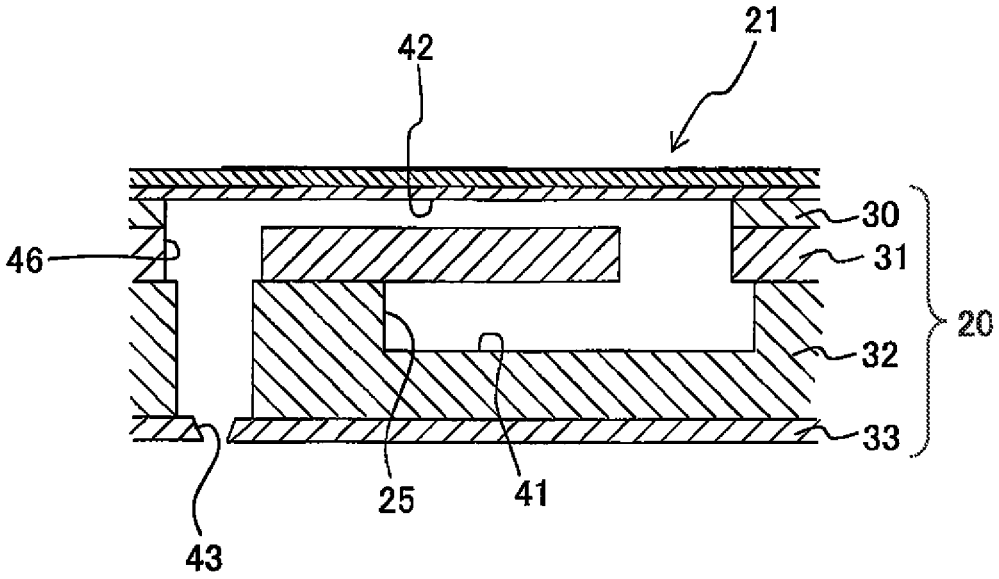
FIGS. 8A and 8B are cross-sectional views corresponding to FIG. 4, each illustrating an ink-jet head of another modified embodiment.
Figure 8B:
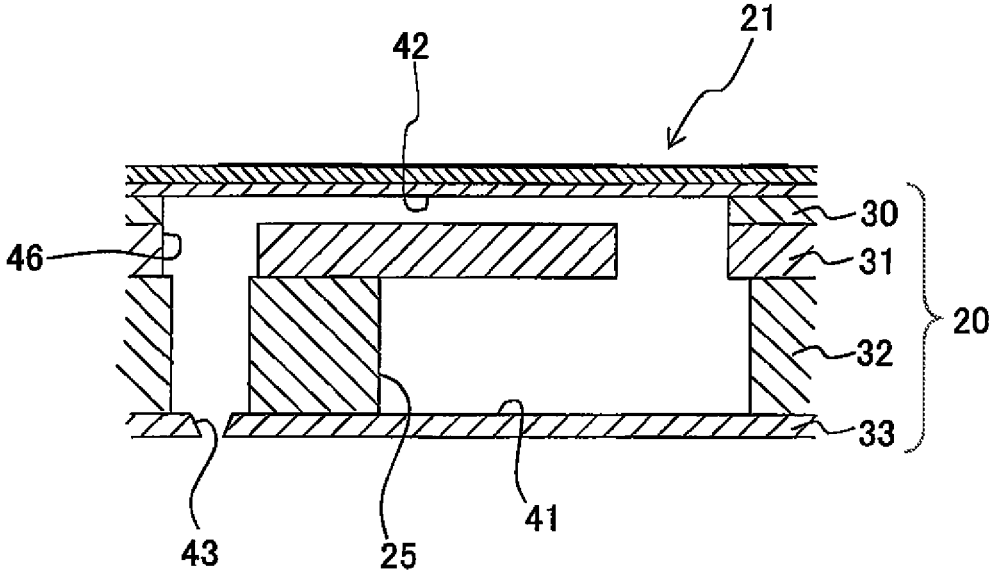

In order to increase the depth of the manifold 41, for example, as shown in FIGS. 7A and 7B, the manifold 41 is formed to have a plurality of manifold plates 32*a*, 32*b* in a stacked state. Then, as shown in FIG. 7B, the elongated hole 25 is formed in each of the two manifold plates 32*a*, 32*b*. Accordingly, the channel resistance in the manifold 41 in FIG. 7B may be decreased as compared with a case, as shown in FIG. 7A, in which the elongated hole 25 is formed only in one manifold plate 32*a*. Alternatively, as shown in FIGS. 8A and 8B, the channel resistance in the manifold 41 may be decreased as follows. That is, the manifold plate 32 is formed to have a large thickness; and the elongated hole 25 formed in one manifold 41 is formed to have a deep depth.

As described above, in a case that the depth of the manifold 41 is increased to reduce the channel resistance, a planar size of the ink-jet head 4 does not become large, as compared with a case in which the width of the manifold 41 is increased.

It is not indispensable to increase the channel sectional area of the manifold 41 in order to decrease the channel resistance of the manifold 41. The channel resistance of the manifold 41 can be reduced by changing a shape of the channel. For example, a distance from the ink supply port 40 of the manifold 41 in which the channel resistance is made to be small may be shorter than those of other manifolds 41. Or the manifold 41 in which the channel resistance is made to be small may have a rectilinear channel shape having a smaller number of bent portions as compared with other manifolds 41. Alternatively, it is possible to decrease the channel resistance by reducing surface roughness of an inner surface of the manifold 41.

Figure 9:
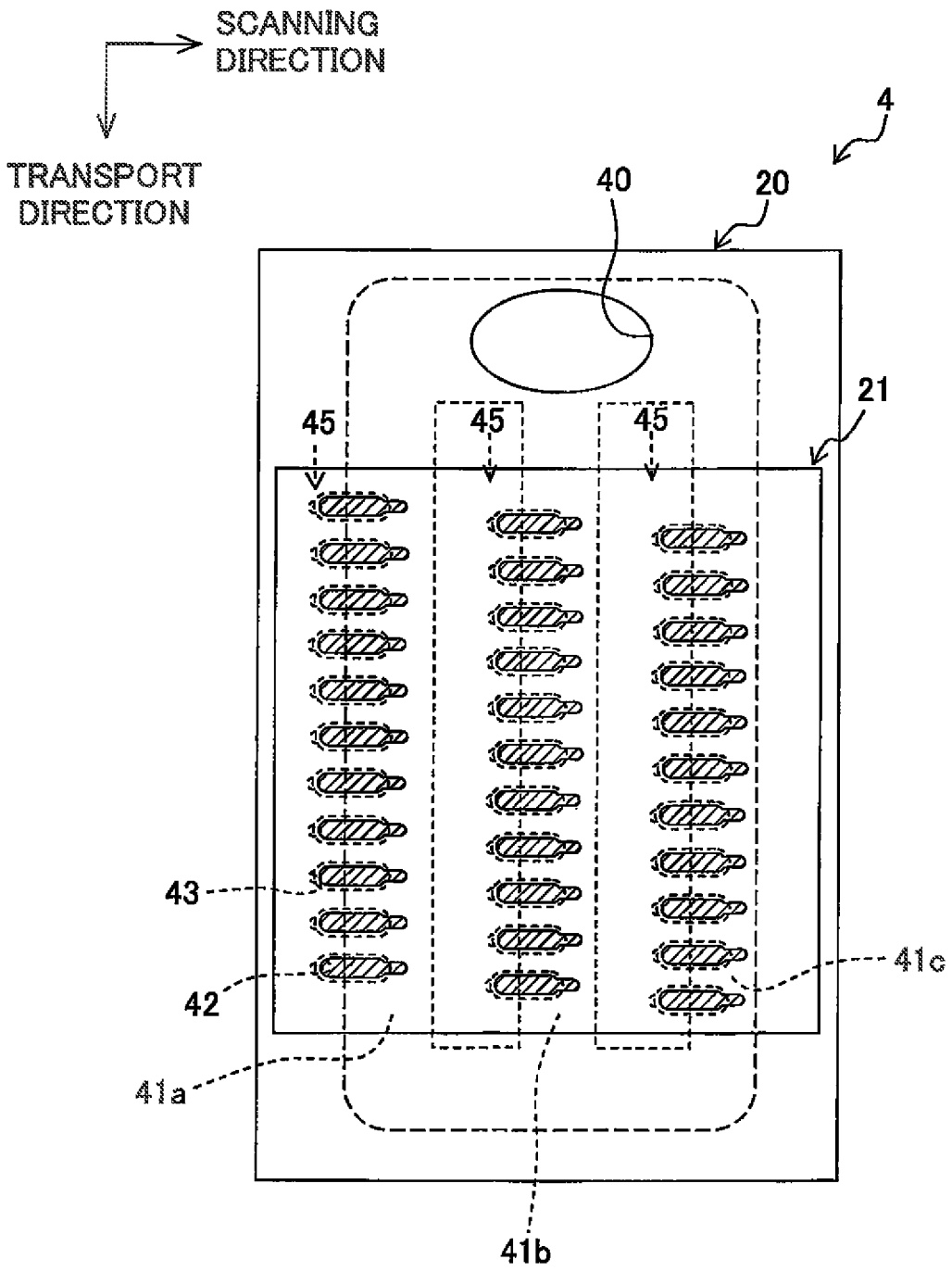
FIG. 9 is a plan view of an ink-jet head of still another modified embodiment.

In the above embodiment, two arrays of the nozzle arrays 45 are communicated with each of the manifolds 41. As shown in FIG. 9, however, it may be configured that each of the manifold 41 is communicated with one nozzle array 45.

Figure 10:
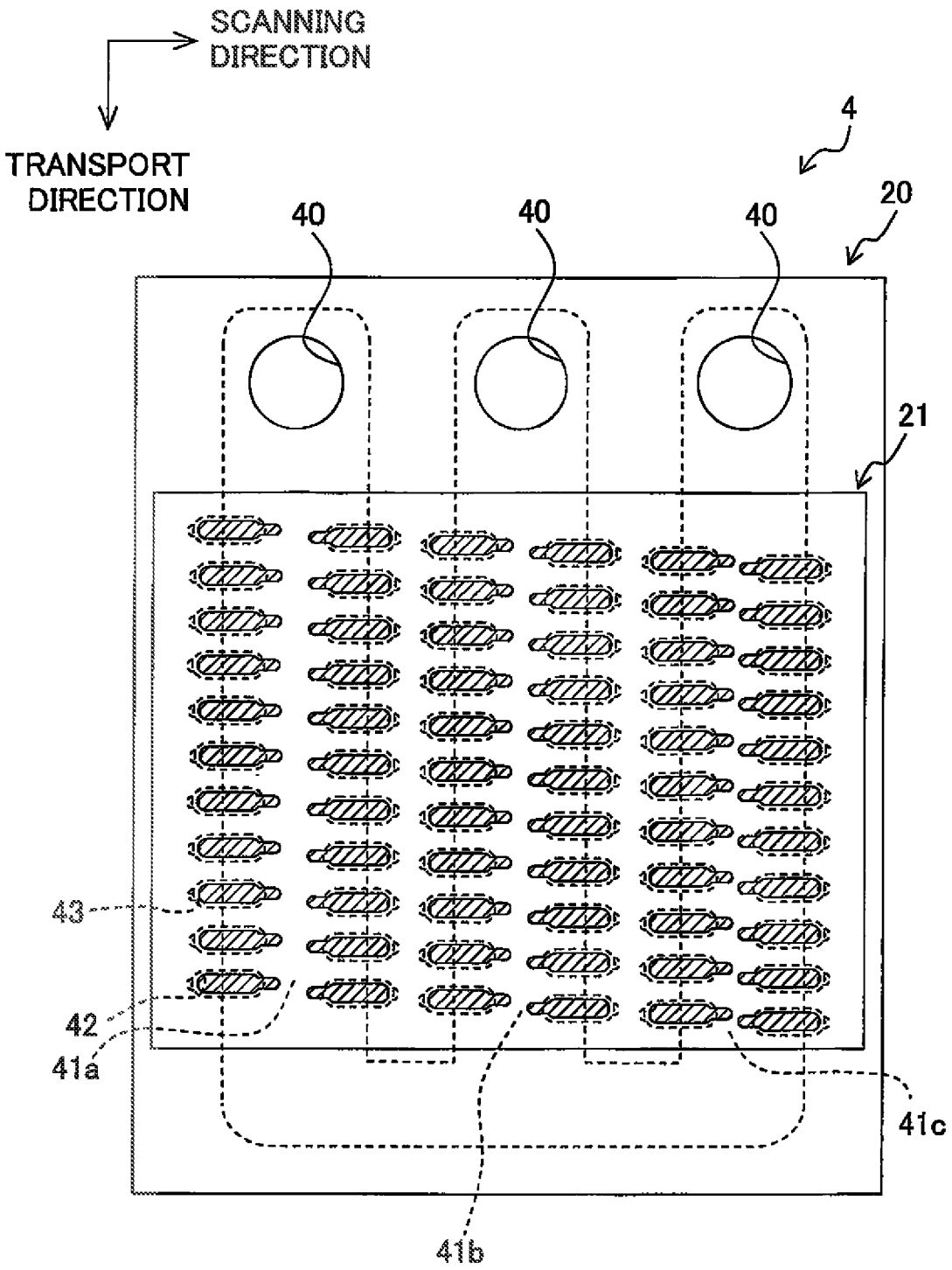
FIG. 10 is a plan view of an ink-jet head of yet another modified embodiment.

In the above embodiment, the three manifolds 41 are communicated with one ink supply port 40. As shown in FIG. 10, however, the following configuration is also allowable. That is, the same number of ink supply ports 40 as the number of manifolds 41 is provided in the channel unit 20, and each of the manifolds 41 is communicated with one of the ink supply ports 40.

Figure 11:
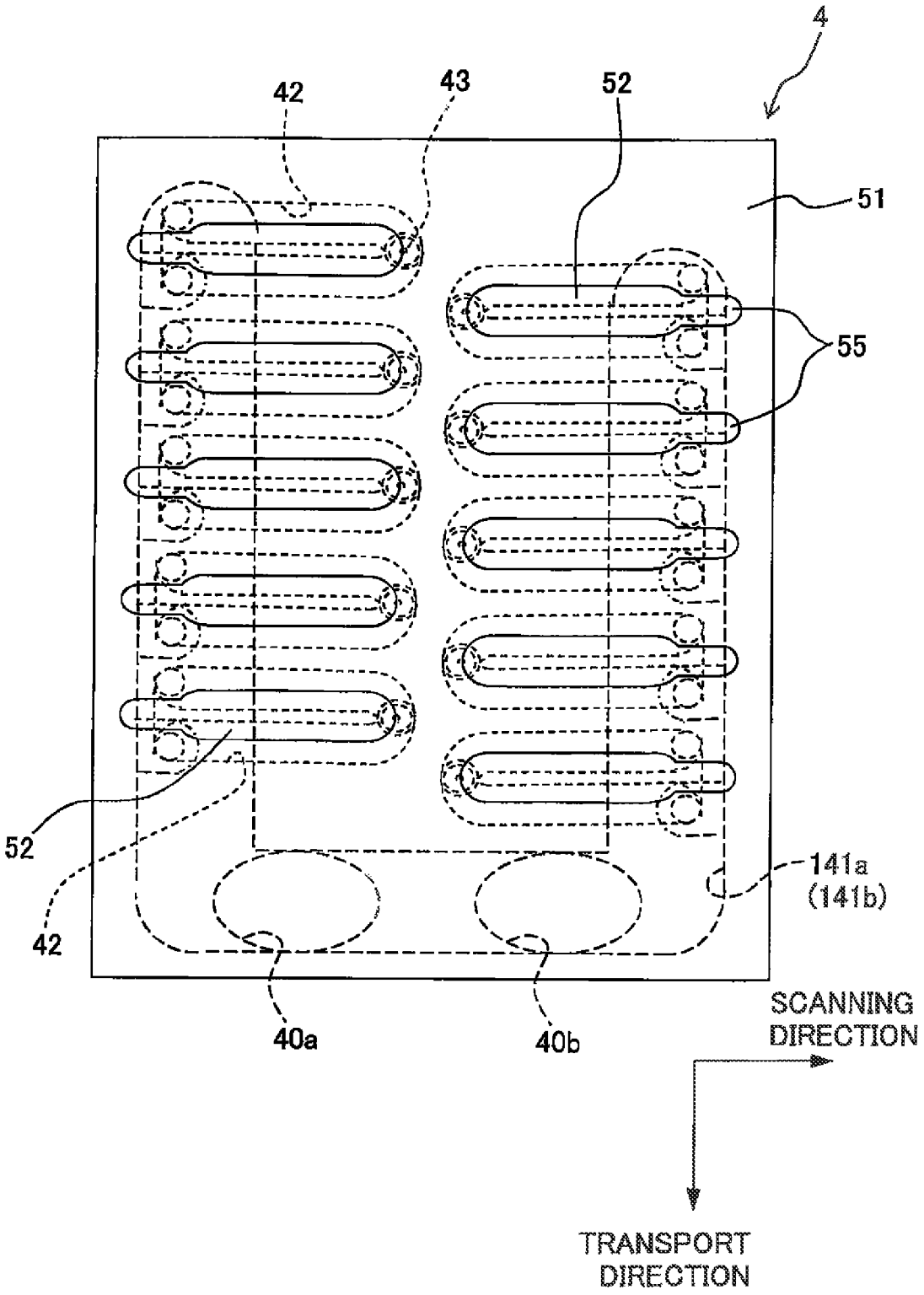
FIG. 11 is a plan view of an ink-jet head of further modified embodiment.

In the above embodiment, the three manifolds 41 are communicated with one ink supply port 40, and are communicated with one another by the connecting channel 49 on the side opposite to the ink supply port 40. However, the configuration of the manifold is not limited thereto. For example, in a configuration as shown in FIG. 11, the ink is supplied from both two ink supply ports 40*a*, 40*b* in an ink jetting mode in which the ink is jetted from the nozzles 43. On the other hand, in a case that air bubbles mixed in the ink-jet head 4 are discharged, the ink jetting mode is switched to an ink circulation mode, the ink is supplied to the ink-jet head 4 from one of the two ink supply ports 40*a*, 40*b*, and the air bubbles are discharged, together with the ink in the ink-jet head 4, from the other of two ink supply ports 40*a*, 40*b*. Thus, the following configuration is also allowable. That is, two common liquid chambers 141*a*, 141*b* are communicated with each other at end portions thereof on the downstream side in the transport direction; and the two ink supply ports 40*a*, 40*b* are formed in the communicating portion of the two common liquid chambers 141*a*, 141*b*.

The number of manifolds 41 can change depending on any other conditions, such as the number of nozzle arrays 45. For example, the following configuration is also allowable. That is, only two manifolds 41 are communicated with each other, or four or more of manifolds 41 are communicated with one another. Further, it is not indispensable that all of the manifolds 41 are communicated with the same number of nozzle arrays 45. The number of nozzle arrays 45 communicating with a part of the manifolds 41 may be different from the number of nozzle arrays 45 communicating with each of the remaining part of the manifolds 41. However, in a case that the present teaching is applied to such a configuration, the channel resistance is required to vary between two or more of manifolds 41, among all of the manifolds 41, which have the same number of nozzle arrays 45, each of which is communicated with one of the two or more manifolds 41.

In the above embodiment, all of the manifolds 41 are communicated with the same number of nozzle arrays 45, that is, the same number of nozzles 43. However, even in the case in which all of the manifolds 41 are communicated with the same number of nozzle arrays 45, the number of nozzles 43 included in one nozzle array 45 may vary for each of the nozzle arrays 45. For example, it is assumed that all of the nozzles 43 have the same diameter and that the liquid droplets of the ink are jetted from all of the nozzles 43 of each of the nozzle arrays 45. Under this assumption, in a case that the number of nozzles 43 included in the nozzle array 45*a* is smaller than the number of nozzles 43 included in the nozzle array 45*b*, the ink amount consumed in the nozzle array 45*a* is smaller than the ink amount consumed in the nozzle array 45*b*. Therefore, from a viewpoint of suppressing the supply shortage of ink, it is desirable that the liquid droplets of the ink are jetted from the nozzle array 45*a*, the nozzle array 45*b*, in that order. In this case, it is desirable that the channel resistance of the manifold communicating with the nozzle array 45*b* from which the liquid droplets of the ink are jetted at the later timing is smaller than the channel resistance of the manifold communicating with the nozzle array 45*a* from which the liquid droplets of the ink are jetted at the earlier timing.

In the above embodiment, all of the manifolds 41 are communicated with the same number of nozzle arrays 45 and all of the nozzles 43 have the same diameter. However, even in the case in which all of the manifolds 41 are communicated with the same number of nozzle arrays 45, the diameter of the nozzle 43 may vary for each of the nozzle arrays 45. For example, it is assumed that each of the nozzle arrays 45 includes the same number of nozzles 43 and that the liquid droplets of the ink are jetted from all of the nozzles 43 of each of the nozzle arrays 45. Under this assumption, in a case that the diameter of each nozzle 43 included in the nozzle array 45*a* is smaller than the diameter of each nozzle 43 included in the nozzle array 45*b*, the ink amount consumed in the nozzle array 45*a* is smaller than the ink amount consumed in the nozzle array 45*b*. Therefore, from a viewpoint of suppressing the supply shortage of ink, it is desirable that the liquid droplets of the ink are jetted from the nozzle array 45*a*, the nozzle array 45*b*, in that order. In this case, it is desirable that the channel resistance of the manifold communicating with the nozzle array 45*b*, which has each nozzle 43 having a large diameter and from which the liquid droplets of the ink are jetted at the later timing, is smaller than the channel resistance of the manifold communicating with the nozzle array 45*a*, which has each nozzle 43 having a small diameter and from which the liquid droplets of the ink are jetted at the earlier timing.

In the above embodiment, the explanation is made with respect to the example in which the present teaching is applied to an ink-jet head of a so-called serial type which jets the ink on the recording paper sheet while moving in the scanning direction. In addition to this, there is also known an ink-jet head of a so-called line-type which has a nozzle array, the length of which is equivalent to a width of the recording paper sheet; and from which the ink is jetted onto the transported recording paper sheet in a state that the position of the ink-jet head is fixed. It is possible to understand easily that the same problem as the serial-type ink-jet head occurs also in the line-type ink-jet head. Thus, the present teaching is applicable to the line-type ink-jet head.

The embodiment and the modified embodiments thereof explained above are examples in which the present teaching is applied to the ink-jet head which is one of liquid droplet jetting apparatuses and which jets the ink. However, the application objective of the present teaching is not limited thereto. That is, the present teaching is applicable irrelevant to the type of the liquid to be jetted, the way of use, and the technical field.

What is claimed is:

1. A liquid droplet jetting apparatus which is controlled by a controller to jet liquid droplets of a liquid supplied from a liquid supply section, the apparatus comprising:

a channel unit which includes:

a liquid supply port which is communicated with the liquid supply section and from which the liquid is supplied;

a plurality of nozzle arrays each of which is formed of a plurality of nozzles aligned in a first direction and from which the liquid droplets of the liquid are jetted, the nozzle arrays being arranged in a second direction intersecting with the first direction, and the nozzle arrays including a first nozzle array and a second nozzle array from which the liquid droplets are jetted at a later timing than the first nozzle array in accordance with a predetermined jetting order; and a plurality of common liquid chambers which are communicated with the liquid supply port and through which the liquid supplied to the liquid supply port is supplied to the plurality of nozzle arrays, the same number of nozzle arrays, of the plurality of nozzle arrays, being communicated with each of the common liquid chambers, each of the common liquid chambers being communicated with at least one of the plurality of the common liquid chambers at a portion different from a portion communicating with the liquid supply port, and the common liquid chambers including a first common liquid chamber which is communicated with the first nozzle array and a second common liquid chamber which is communicated with the second nozzle array; and an actuator which is controlled by the controller to apply a jetting energy to the liquid supplied to the plurality of nozzle arrays so that the liquid droplets are jetted from each of the nozzle arrays in accordance with the predetermined jetting order;

wherein a channel resistance of the second common liquid chamber is smaller than a channel resistance of the first common liquid chamber; and wherein a cross-sectional area, of the second common liquid chamber, in a cross section perpendicular to a liquid flow direction in the second common liquid chamber is larger than a cross-sectional area, of the first common liquid chamber, in a cross section perpendicular to a liquid flow direction in the first common liquid chamber.

2. The liquid droplet jetting apparatus according to claim 1;

wherein a plurality of liquid channels including the plurality of nozzle arrays and the plurality of common liquid chambers are formed in the channel unit;

wherein the channel unit has a structure in which a plurality of plates, each of which has a channel hole defining a part of one of the liquid channels, are stacked;

wherein each of the common liquid chambers is formed so that a plate, of the plurality of plates, is stacked on a manifold plate, in which the channel hole defining each of the common liquid chambers is formed, to cover the channel hole defining each of the common liquid chambers; and each of the liquid channels is formed so that the liquid flows, in each of the common liquid chambers, along a surface direction of the manifold plate; and wherein, with respect to the surface direction of the manifold plate, a width, of the second common liquid chamber, in the cross section perpendicular to the liquid flow direction in the second common liquid chamber is larger than a width, of the first common liquid chamber, in the cross section perpendicular to the liquid flow direction in the first common liquid chamber.

3. The liquid droplet jetting apparatus according to claim 1;

wherein a plurality of liquid channels including the plurality of nozzle arrays and the plurality of common liquid chambers are formed in the channel unit;

wherein the channel unit has a structure in which a plurality of plates, each of which has a channel hole defining a part of one of the liquid channels, are stacked;

wherein each of the common liquid chambers is formed so that a plate, of the plurality of plates, is stacked on a manifold plate, in which the channel hole defining each of the common liquid chambers is formed, to cover the channel hole defining each of the common liquid chambers; and each of the liquid channels is formed so that the liquid flows, in each of the common liquid chambers, along a surface direction of the manifold plate; and wherein with respect to a thickness direction of the manifold plate, a depth, of the second common liquid chamber, in the cross section perpendicular to the liquid flow direction in the second common liquid chamber is larger than a depth, of the first common liquid chamber, in the cross section perpendicular to the liquid flow direction in the first common liquid chamber.

4. A liquid droplet jetting apparatus which is controlled by a controller to jet liquid droplets of a liquid supplied from a liquid supply section, the apparatus comprising:

a channel unit which includes:

a liquid supply port which is communicated with the liquid supply section and from which the liquid is supplied;

a plurality of nozzle arrays each of which is formed of a plurality of nozzles aligned in a first direction and from which the liquid droplets of the liquid are jetted, the nozzle arrays being arranged in a second direction intersecting with the first direction, and the nozzle arrays including a first nozzle array and a second nozzle array from which the liquid droplets are jetted at a later timing than the first nozzle array in accordance with a predetermined jetting order; and a plurality of common liquid chambers which are communicated with the liquid supply port and through which the liquid supplied to the liquid supply port is supplied to the plurality of nozzle arrays, the same number of nozzle arrays, of the plurality of nozzle arrays, being communicated with each of the common liquid chambers, each of the common liquid chambers being communicated with at least one of the plurality of the common liquid chambers at a portion different from a portion communicating with the liquid supply port, and the common liquid chambers including a first common liquid chamber which is communicated with the first nozzle array and a second common liquid chamber which is communicated with the second nozzle array; and an actuator which is controlled by the controller to apply a jetting energy to the liquid supplied to the plurality of nozzle arrays so that the liquid droplets are jetted from each of the nozzle arrays in accordance with the predetermined jetting order;

wherein a channel resistance of the second common liquid chamber is smaller than a channel resistance of the first common liquid chamber;

wherein the actuator applies the jetting energy to the liquid so that the liquid droplets are jetted in an order from a nozzle array disposed at front end in the second direction;

wherein the liquid droplet jetting apparatus is reciprocatively movable in the second direction and a third direction opposite to the second direction;

wherein, in a case that the liquid droplet jetting apparatus is moved in the second direction, the actuator applies the jetting energy to the liquid so that the liquid droplets are jetted in the order from the nozzle array disposed at the front end in the second direction;

wherein, in a case that the liquid droplet jetting apparatus is moved in the third direction, the actuator applies the jetting energy to the liquid so that the liquid droplets are jetted in an order from a nozzle array disposed at front end in the third direction;

wherein, in a case that an entire amount of the liquid, which is jetted from the plurality of nozzle arrays per unit time, is not less than a predetermined amount, the liquid droplets are jetted from the plurality of nozzle arrays by the actuator in a case in which the liquid droplet jetting apparatus is moved only in the second direction; and wherein, in a case that the entire amount of the liquid, which is jetted from the plurality of nozzle arrays per unit time, is less than the predetermined amount the liquid droplets are jetted from the plurality of nozzle arrays by the actuator in a case in which the liquid droplet jetting apparatus is moved both in the second direction and the third direction.

5. The liquid droplet jetting apparatus according to claim 4;

wherein the channel unit includes three or more of the common liquid chambers;

wherein a nozzle array, of the three or more of the common liquid chambers, which is disposed at the last row in the second direction is the second nozzle array; and wherein a plurality of common liquid chambers, which are respectively communicated with nozzle arrays other than the second nozzle array, have the same channel resistance.

6. A liquid droplet jetting apparatus which is controlled by a controller to jet liquid droplets of a liquid supplied from a liquid supply section, the apparatus comprising:

a channel unit which includes:

a liquid supply port which is communicated with the liquid supply section and from which the liquid is supplied;

a plurality of nozzle arrays each of which is formed of a plurality of nozzles aligned in a first direction and from which the liquid droplets of the liquid are jetted, the nozzle arrays being arranged in a second direction intersecting with the first direction, and the nozzle arrays including a first nozzle array and a second nozzle array from which the liquid droplets are jetted at a later timing than the first nozzle array in accordance with a predetermined jetting order; and a plurality of common liquid chambers which are communicated with the liquid supply port and through which the liquid supplied to the liquid supply port is supplied to the plurality of nozzle arrays, the same number of nozzle arrays, of the plurality of nozzle arrays, being communicated with each of the common liquid chambers, each of the common liquid chambers being communicated with at least one of the plurality of the common liquid chambers at a portion different from a portion communicating with the liquid supply port, and the common liquid chambers including a first common liquid chamber which is communicated with the first nozzle array and a second common liquid chamber which is communicated with the second nozzle array; and an actuator which is controlled by the controller to apply a jetting energy to the liquid supplied to the plurality of nozzle arrays so that the liquid droplets are jetted from each of the nozzle arrays in accordance with the predetermined jetting order;

wherein a channel resistance of the second common liquid chamber is smaller than a channel resistance of the first common liquid chamber; and wherein each of the common liquid chambers extends in the first direction, is communicated with the liquid supply port on one end side in the first direction, and is communicated with at least one of the plurality of common liquid chambers at a terminal portion on the other end side in the first direction.

7. The liquid droplet jetting apparatus according to claim 6;

wherein each of the common liquid chambers is communicated with at least one of the nozzle arrays;

wherein the at least one of the nozzle arrays includes a farthest nozzle which is farthest from the liquid supply port in the first direction; and wherein the terminal portion is farther from the liquid supply port than the farthest nozzle.

8. The liquid droplet jetting apparatus according to claim 6;

wherein the plurality of nozzles included in each of the plurality of nozzle arrays is aligned in the first direction at a same pitch.

* * * * *